United States Patent [19]

Smith

[11] Patent Number: 4,686,723

[45] Date of Patent: Aug. 18, 1987

[54] SEMI-FLUIDIZED BED

[75] Inventor: James W. Smith, Toronto, Canada

[73] Assignee: The University of Toronto Innovations Foundation, Toronto, Canada

[21] Appl. No.: 799,839

[22] Filed: Nov. 14, 1985

[51] Int. Cl.[4] ..... A61G 7/04

[52] U.S. Cl. ..... 5/453; 422/143

[58] Field of Search ..... 5/453, 449, 450; 210/661; 422/143; 34/57 A; 110/245

[56] References Cited

U.S. PATENT DOCUMENTS

| | | | |
|---|---|---|---|
| 2,654,659 | 10/1953 | Friedman | 422/143 |
| 2,850,808 | 9/1958 | Jones et al. | 422/143 |
| 2,884,373 | 4/1959 | Bailey | 422/143 |
| 3,428,973 | 2/1969 | Hargest et al. | 5/423 |
| 3,565,593 | 2/1971 | Moore | 422/143 |
| 3,607,123 | 9/1971 | Russell et al. | 422/143 |
| 3,866,606 | 2/1975 | Hargest | 128/71 |
| 4,481,686 | 11/1984 | Lacoste | 5/453 |
| 4,483,029 | 11/1984 | Paul | 5/453 |

OTHER PUBLICATIONS

Smith et al, The Canadian Journal of Chem. Eng., Oct., 1964, Spouting of Mixed Particle-Size Beds, pp. 206-210.

Reddy et al, The Canadian Journal of Chem. Eng., vol. 46, Oct., 1968, Maximum Spoutable Bed Depths of Mixed Particle-Size Beds, pp. 329-334.

Reddy et al., American Institute of Chem. Engineers., Maximum Spoutable Bed Depths of Mixed Particle--Size Beds, Preprint 30B, Presented at the Symposium on Fundamental and Applied Fluidization—Part 1, Second Joint AlChE-IIQPR Mtg., Tampa, Fla., May 19-22, 1968.

*Primary Examiner*—Alexander Grosz

*Attorney, Agent, or Firm*—Fleit, Jacobson, Cohn & Price

[57] ABSTRACT

A bed is disclosed, comprising a base having a floor and an upstanding wall extending aroung the periphery of the floor. A body of particulate fluidizable material is contained within the base. The floor has an elongate slit connectable to an air supply and a pair of inclined surfaces extending upwardly on opposite sides of the slit. Supply of air to the slit causes circulation of the particulate material along the inclined surfaces towards the slit and causes fluidization of the upper region of the base.

11 Claims, 3 Drawing Figures

SEMI-FLUIDIZED BED

Figure 1:
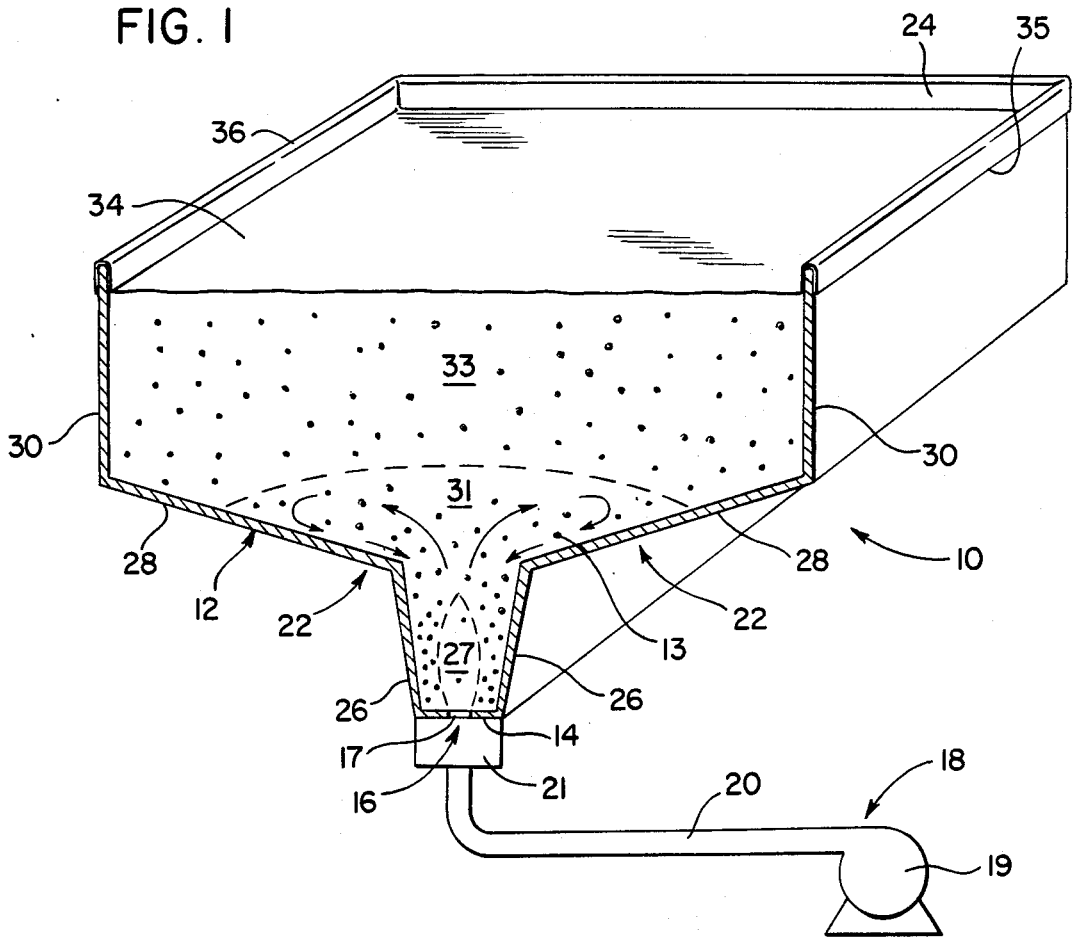

This invention relates to beds.

Conventional beds have a resilient mattress provided either by springs or foam. When a person lies on such a bed, his weight is not uniformly distributed so that zones of relatively high pressure arise between the support surface of the bed and parts of the body. When used in a hospital environment, these zones can cause ulcerations and bed sores in patients who are confined to bed for long periods of time, and can cause discomfort and cause problems with the healing process of burn victims.

To obviate some of these problems, a number of different fluidised hospital bed designs have been devised. These designs are exemplified by U.S. Pat. Nos. 3,428,973; 3,866,606; 4,481,686; and 4,483,029. These fluidised beds provided a uniform weight distribution and are also advantageous in that they are clean, simple to operate, have bacteriocidal properties and apply extremely low hydrostatic pressure to any part of the supported patient.

Generally, these fluidised hospital beds have a rectangular-sectioned base with substantially vertical walls to contain with particles of ceramic or glass therein. At the lower part of the base, there is an air inlet. A diffuser plate, generally made of particle board of uniform porosity is interposed between the pressurized air inlet and the particles. A flexible sheet is located above the particles upon which a patient can be supported. Pressurized air is fed into the base through the air inlet by a blower. The air then passes through the diffuser plate and fluidizes the particles, thereby suspending the flexible sheet and a patient lying thereon.

A disadvantage of the these fluidised beds is that a large pressure drop results across the diffuser, therefore a high-powered air blower system is required, which tends to be noisy and expensive. Also, the beds are extremely heavy because of the large number of particles are required. Extra floor reinforcements are required to support the bed, which are costly and not always feasible, expecially in older buldings.

It is an object of the present invention to obviate or mitigate the above-mentioned disadvantages.

Accordingly, the invention provides a bed comprising a base having a floor and an upstanding wall extending around the periphery of the floor. A body of particulate fluidisable material is contained within the base. The floor has an elongate slit connectable to an air supply and a pair of inclined surfaces extending upwardly on opposite sides of the slit. Supply of air to the slit causes circulation of the particulate material along the inclined surfaces towards this bed and causes fludisation of the upper region of the base.

The use of a slit results in a spout of air which extends partially through the body of particles. This arrangement is known as a semi-spouting fluidised bed and promotes circulation of particles and fluidisation of the upper zone of such particles in the body.

The distribution of air through a slit, rather than through a diffuser plate, results in a lower pressure drop, thereby obviating the need for a relatively high-powered air blower system. Also, the lower pressure drop results in a lower temperature rise in the bed, which increases the comfort of the patient. The inclined surfaces lead to reduced weight because of the reduced internal volume of the base. The fluidisation in the upper part of the bed ensures that the quality of the fluidised surface which contacts the patient is maintained. Also, the average particle diameter can be greater in the system of the present invention, as the lower region of the base may contain larger particles than the upper fluidised region.

Preferably, the slit extends parallel to the longitudinal axis of the floor. This orientation of the slit results in the optimum circulation of the beads to produce the desired fluidisation effect.

In another of its aspects the invention provides a base to contain a body of particulate material to form a bed, said base comprising a floor and an upstanding wall extending around the periphery of said floor, said floor having a pair of mutually inclined surfaces converging downwardly toward an elongage slit.

In a further one of its aspects the invention provides a method of providing a support for a prone body comprising the steps of containing particulate material within a base having a floor with a pair of downwardly converging inclined surfaces, providing pressurized air to an elongate inlet slit located adjacent each of said surfaces, and maintaining said air supply to induce movement of said particulate material along said inclined surface and fluidisation of an upper layer of said material to provide a fluidised bed of material to support said prone body.

The invention involves the idea of having a semi-spouting fluidised bed, as opposed to a conventional fluidised bed. A semi-spouting bed consists of three distinct regions; the spouting region, the fluidised region and a transition region in between. The spout region consists of jet-like upward moving beads directly above the slit, surrounded by slow downward moving beads through which gas percolates. Gas from the slit of the base leaks into the downward moving fixed beads on either side of the upward moving beads due to the pressure gradient generated by the relative motion between the gap and beads within the spout. This region is characterized by a high air velocity and relatively low pressure drop and is generally made up of near monodisperse particles of a diameter greater than 1.0 mm.

The fluidised region is similar to that of a conventional fluidised bed, in which particles are all suspended in the liquid flow of gas. Because the gas velocity is greater, the fluidised region is like that of a conventional fluidised bed, in which the particles are all suspended in the upward flow of gas. Because the gas velocity is greater than the minimum fluidisation velocity of the gas some of the gas passes up through the beads as bubbles. In general fluidisation is possible for particles of from 45 um to 300 um.

A semi-spouted system is a combination of a conventional fluidised system and a spouted system. However, the addition of the small particles necessary for a fluidised top portion of the system results in the collapse of the otherwise fully developed spout of monodisperse particles at a certain height above the slit.

The result of the collapsing of the spout is a transitional region between the spouting region and fluidised region in which the spouting particles lose momentum, and the air is distributed across the fluidised region above. The depth and composition of this region is important in obtaining even distribution of upward air flow across the bed. Uneven distribution will result in large bubble formation or channelling of a disproportionately large amount of air along a few particular paths in the bed.

In shallow fluidised beds (<1 meter deep) the quality of fluidisation is strongly influenced by the type of gas distributor used. For a distributor having many openings, fluctuation in the bed density is negligible, bubbles are smaller and channelling is less common. Traditionally the use of a high pressure drop distributor results in good air distribution, and therefore better fluidisation, at the cost of pressure energy loss. The application of a semi-spouted system greatly reduces the required pressure output needed for a conventional system. The total pressure drop across a fluidised bed is made up of two components: the pressure drop across the distributor ($\Delta P_D$), and the pressure drop across the bed itself ($\Delta P_B$). This second component is a direct function of the bed depth. By reducing the depth of the actual fluidising portion and replacing it with a spouting sytem, which has a relatively low pressure drop, the system pressure drop can be dramatically reduced. In addition, the transitional region in the bed acts to further distribute the air enabling a high quality of fluidisation without a high system pressure drop.

Figure 2:
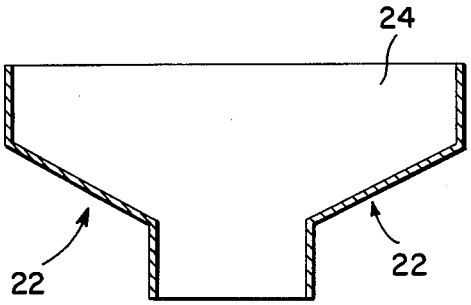
Figure 3:
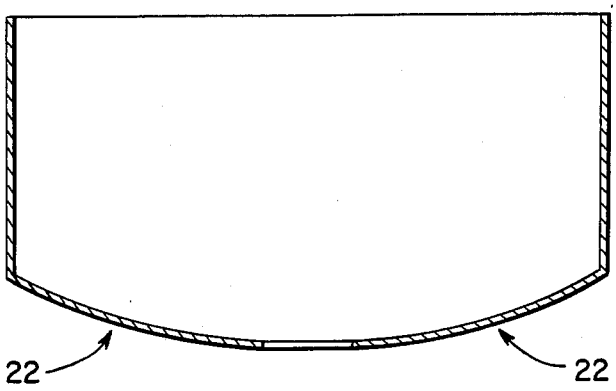

A preferred embodiment of the invention will now be disclosed, by way of example only, with reference to the following drawings in which:

FIG. 1 shows a perspective view of a fluidised bed with a portion cut away to show a cross-section of the bed, and FIG. 2 shows a cross section of a fluidized bed similar to that shown in FIG. 1; and FIG. 3 is a cross-section of a fluidised bed similar to that shown in FIG. 2.

As can be seen in FIG. 1, a bed 10 has a base 12 containing a body of particles 13. The base 12 has a longitudinally extending floor 14 with a laterally spaced elongate inlet slit 16 therein. This slit 16 extends longitudinally parallel to the longitudinal axis of the floor. A mesh screen 17 extends across the slit 16 and an air supply 18 is connected thereto. The air supply consists of a blower 19, connected by a duct 20 to a manifold 21 which communicates with the slit.

Each of the slits 16 is defined by a pair of opposed walls 22 connected to one another at each end by transversly extending walls 24. The lower portions 26 of the longitudinally extending walls 22 are inclined in opposite directions at an angle of about 60° to the horizontal. The intermediate portions 28 of the walls 22 are inclined in opposite directions at an angle of between 30° to 75° to the horizontal and the upper portions 30 of the walls are vertical.

A flexible, air-permeable sheet material 34 is received in the top edge 36 of the wall 30 and its edges 35 are folded over the top edges of the longitudinal and transverse walls 22, 24, and secured thereto.

The operation of the bed will now be described with reference to FIG. 1. Air is blown into the fluidised bed by the blower 19. In a spouting region identified by numeral 27, a jet of particles 13 rise and move radially outward from the slit as indicated by the arrows, and into a transition region 31. The particles in the transition region 31 are caused to fall by the smaller particles in the fluidised region 33 onto the intermediate portions of the walls 28. The angle of the inclination of these surfaces is greater than the angle of repose of the particles, therefore the particles slide along the surfaces toward the slit 16. A continuous circulation of particles is thus established. The smaller particles tend to become fluidised in a fluidised region 33 to provide a uniform fluidised support for the air permeable sheet. The air exits through the air permeable sheet 34, to provide ventilation.

The total pressure drop in the fluidised bed of the prior art is about 55 cm water. With the present invention pressure drop is about 33 cm water, which is a 30 to 40% reduction in pressure drop. The pressure drop in previously known fluidised beds results in a temperature rise, typically about 5° F. With the fluidised bed of the present invention, the temperature rise is typically about 2° to 3° F. which is significantly lower than previously known fluidised beds, especially when the bed is used for burn victims who require as cool an environment as possible. The fluidised bed of the present invention also can use larger, less expensive glass beads, generally of an average diameter of 1.16 cm in the spouting portion, and glass beads of an average diameter of 448 μm in the fluidized portion. The size range of these glass spheres is 297–603 μm and the variance is $\sigma^*=0.268$ where $$\sigma^* = \frac{\sigma}{d_{p50\%}}, \quad \sigma = \frac{d_{p84\%} - d_{p16\%}}{2}$$

Beads used in previously known fluidised beds are generally about 100 microns which are expensive.

It is to be appreciated that modification can be made to the preferred embodiment of the invention within the scope of the invention described and claimed. Instead of having a single slit 16, there could be a plurality of slits or a nozzle in the floor 14 of the base 12. Alternatively, a plurality of transverse slits could be used with inclined surfaces extending to opposite sides thereof. Also, the beads could be held inside the base in a removable screen. The scren and beads can thereby be removed for cleaning. In addition, the transverse walls 24 of the base could be inclined to reduce the weight of the base.

Whilst the longitudinally extending walls 22 have been shown as being planar in FIGS. 1 and 2, they could be curved to decrease the amount of dead space in the bed where circumstances warrant as shown in FIG. 3. Also, a pair of lips can be inserted parallel and adjacent to the slit 16 to enhance spouting, if desired.

EXAMPLE

A particulate bed of cross-sectional dimensions given in FIG. 2 was tested. The slot width is 3.3 cm. The bed is filled 17.8 cm high with spouting material and an additional 12.7 cm high with fluidisable material. The spouting material has a mean diameter of 1.16 cm and the fluidisable material has a mean diameter of 448 μm, a size range of 297–603 μm and a variance of $\sigma^*=0.268$. Table 1 shows the pressure drop and observations made at various flow rates.

TABLE 1

| Flow Rate (cfm) | Pressure Drop Across Distribution ($\Delta P_D$) (cm $H_2O$) | Pressure Drop Across Bed ($\Delta P_B$) (cm $H_2O$) | Observations |
|---|---|---|---|
| 8.5 | 52.4 | 21.1 | onset of fluidization |
| 12.0 | 21.2 | 31.3 | initiation of collapsed spout |
| 11.5 | 13.0 | 25.0 | stable spout, flickers |

TABLE 1-continued

| Flow Rate (cfm) | Pressure Drop Across Distribution ($\Delta P_D$) (cm $H_2O$) | Pressure Drop Across Bed ($\Delta P_B$) (cm $H_2O$) | Observations |
|---|---|---|---|
| 26.0 | n/a | n/a | mixing occurs, both spouting & fluidisation cease |
| 22.0 | 36.0 | 35.4 | mixing at interface increases |

I claim:

1. A patient support bed comprising a generally rectangular base configured to contain a body of particulate material having a floor, said floor having at least one elongate slit extending parallel to the longitudinal axis of said floor and connectable to an air supply, and a pair of inclined surfaces extending upwardly on opposite sides of said slit whereby supply of air to said slit causes circulation of said particulate material along said inclined surfaces toward said slit and fluidisation of the upper region of said body.

2. A bed according to claim 1 wherein each of said inclined surfaces extend to the periphery of said floor.

3. A bed according to claim 2 wherein each of said surfaces is inclined at between 30° and 75° to the horizontal.

4. A bed according to claim 3 wherein the lower portion of said surfaces is inclined at 60° and the upper portion of said surfaces is inclined between 30° and 75°.

5. A bed according to claim 3 wherein said surfaces are curved.

6. A bed according to claim 3 wherein a mesh extends across said slit to inhibit egress of said particulate material.

7. A bed according to claim 1 wherein said particles consist of silica particles having an average diameter of 1.16 cm and glass particles having an average diameter of 448 μm a size range of 297–603 μm and a variance of 0.268.

8. A method of providing a support for a prone body comprising the steps of containing particulate material within a generally rectangular base having a floor with a pair of downwardly converging inclined surfaces, providing pressurized air to an elongate inlet slit extending parallel to the longitudinal axis of said floor and located adjacent each of said surfaces, and maintaining said air supply to induce movement of said particulate material along said inclined surface and fluidisation of an upper layer of said material to provide a fluidised bed of material to support said prone body.

9. A patient support bed comprising a generally rectangular base having a floor and an upstanding wall extending around the periphery of said base, a body of particulate fluidisable material contained within said base and air supply means, said floor having an elongate slit extending parallel to the longitudinal axis of said floor and connected to said air supply, and a pair of surfaces extending upwardly and outwardly from said slit to said wall, said surfaces being inclined to the horizontal at an angle greater than the angle of repose of said particulate material whereby upon supply of air to said slit, circulation of material is promoted within said body and an upper layer of said body is fluidised.

10. A bed according to claim 9 including an air permeable membrane extending across an upper surface of said body.

11. A bed according to claim 10 including a mesh extending across said slit to prevent egress of particulate material therethrough.

* * * * *